US005118106A

United States Patent [19]

Goldman

[11] Patent Number: 5,118,106

[45] Date of Patent: Jun. 2, 1992

[54] ADJUSTABLE GRIP BOWLING AID KIT

[76] Inventor: Arnie B. Goldman, 25608 Cole, Roseville, Mich. 48066

[21] Appl. No.: 548,139

[22] Filed: Jul. 5, 1990

[51] Int. Cl.[5] ..... A63B 37/00

[52] U.S. Cl. ..... 273/63 B; 33/510

[58] Field of Search ..... 273/63 R, 63 A, 63 B, 273/63 E, 63 C, 63 D; 33/509, 510

[56] References Cited

U.S. PATENT DOCUMENTS 3,861,681 1/1975 Kelsey ..... 273/63 B
4,561,654 12/1985 Haza ..... 273/63 B
4,892,308 1/1989 Gaunt ..... 273/63 B

FOREIGN PATENT DOCUMENTS 462156 1/1950 Canada ..... 273/63 B

*Primary Examiner*—George J. Marlo
*Attorney, Agent, or Firm*—Gifford, Groh, Sprinkle, Patmore and Anderson

[57] ABSTRACT

An adjustable aid kit having a thumb sleeve and a pair of finger sleeves of hollow cylindrical form which are placed within the recesses of the bowling ball. Thumb and finger inserts are provided and fit coaxially within the sleeves. The thumb and finger inserts each have a reduced diameter threaded head which is received in a threaded aperture provided in the internal end wall of the sleeves to lock the inserts in the sleeves. The inserts each possess particularly shaped thumb and finger passages which, when employed by the thumb and fingers of the bowler on certain angles, cause particular force vectors to be applied to the bowling ball as the ball is released from the bowler's hand.

3 Claims, 1 Drawing Sheet

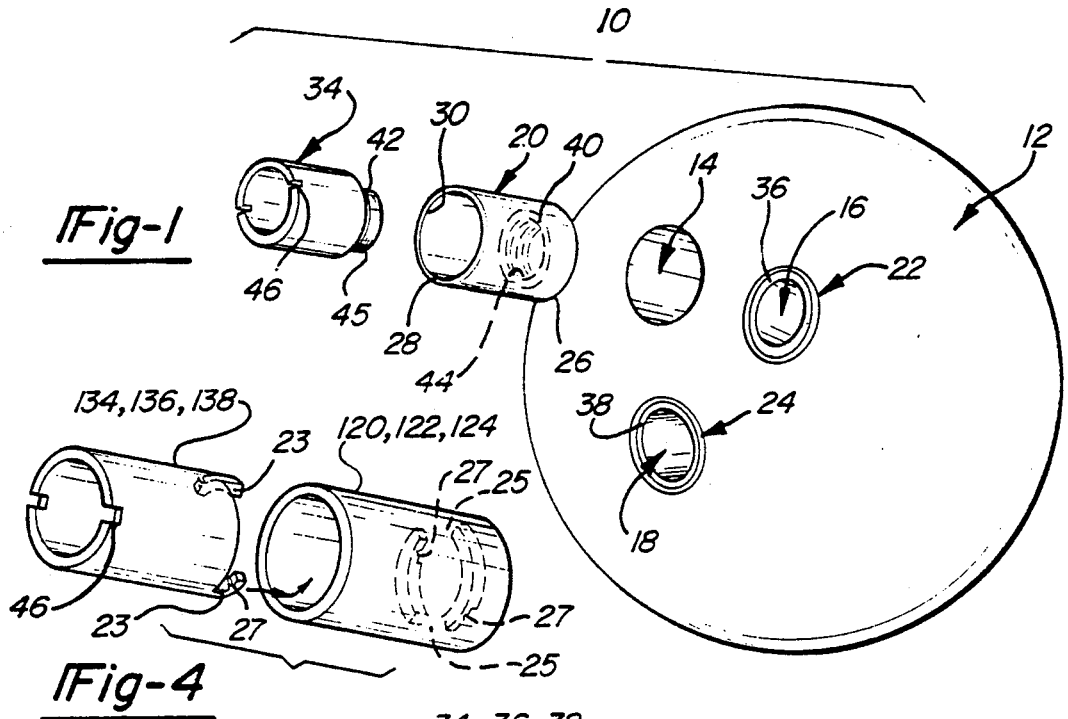
Fig-1
Fig-4
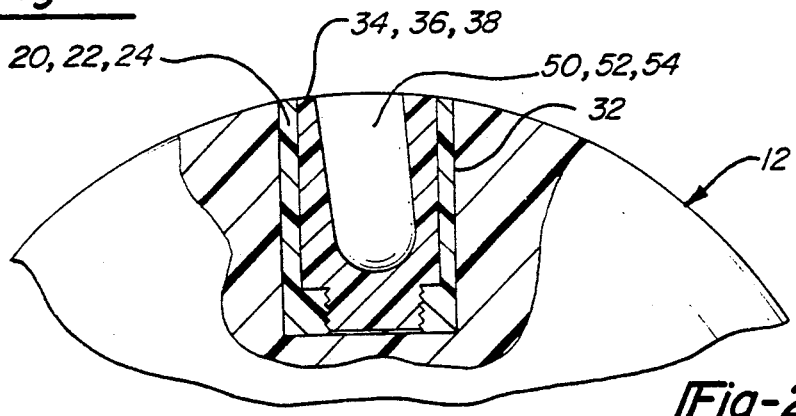
Fig-2
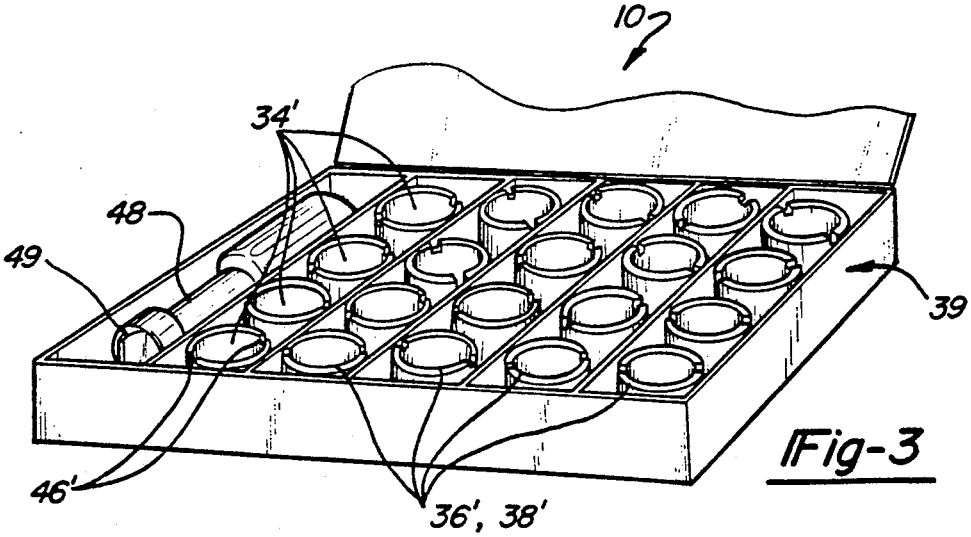
Fig-3

ADJUSTABLE GRIP BOWLING AID KIT

BACKGROUND OF THE INVENTION

I. Field of the Invention

The present invention relates generally to a bowling aid for controlling the balance of a bowling ball in motion and, more particularly, to a device for differentiating the degrees of imbalance necessary to utilize the ultimate dynamics of a bowling ball, through its course of action.

II. Description of the Prior Art

Various devices for compromising the grip of a bowling ball have been employed. These prior art devices include permanent ball plugs which may be inserted to fill a previous hole found to be improperly drilled. Other articles comprise bowling ball inserts for varying the size and texture of the thumb and finger recesses of the bowling ball, which may be affixed to recesses by adhesive means. The object of the latter device is to control the feel of the grip for the purpose of comfort of the bowling ball by the bowler up to the point the bowling ball is released from the bowler's hand. The problem with such inserts is that they are not readily interchangeable while bowling. This deficiency denies the user all of the knowledge and potential advantages such changes would offer. Often, devices such as a glove or brace to be worn upon the hand of the user can create a more regimented stability of the bowling ball during delivery.

Some of these devices are more effective than others. Some are mere "crutches" relying on the principle that sometimes "two negatives can make a positive." What is meant by this is simply that when a bowler is bowling poorly, there is a specific reason for it that is not always readily traced and removed. A practical "remedy" is often suggested that will succeed in covering up the existing problem by altering it, or acting as a "crutch", thus giving the effect that the problem is solved. One such example is a wrist support which simply deals with the problem of an average bowler's inability to properly support a bowling ball during its delivery from the bowlers hand. This results because of the simple fact that the ball is improperly fitted, and more importantly, not balanced to suit the need of its user, consequently causing him stress and strain. The "crutch" may temporarily curb the imbalance without actually removing it. The real underlying problem here is the imbalance causing the stress, which the present invention can ultimately solve.

These prior art ball control devices further do not address the dynamics of a bowling ball once it is released from the hand of the bowler and is proceeding down the length of the bowling lane and towards the bowling pins. What is required is a device for transmitting forces exerted by a bowler's hand on a bowling ball which encourage the ball to acquire a desired path during its travel down the bowling lane. Such a device may additionally provide improved characteristics of the ball both during and after the release stage onto the lane, instituting a more controlled ball roll, direction, and hitting power. This can be attributed to a more refined balanced grip, which in essence, wastes no physics and instead harnesses balance and channels the proper amount of energy to its counterpart destination on the lane.

SUMMARY OF THE PRESENT INVENTION

The present invention provides an adjustable grip aid kit which addresses the shortcomings of the prior art devices.

In brief, the adjustable grip bowling aid kit of the present invention comprises a thumb sleeve and a pair of finger sleeves which are adaptable to being coaxially placed within the thumb and finger recesses of a bowling ball. The sleeves are permanently fastened to the walls of the ball recesses with the aid of cement or glue.

Thumb and finger inserts are provided which fit within the sleeves in a like coaxial manner. Formed within the thumb and finger inserts are passages which accommodate the thumb and fingers of the bowler. The passages are defined within the inserts such that at the point of ball release the thumb and fingers of the bowler encourage particular forces to be exerted on the bowling ball by the bowler. As a consequence, the bowling ball acquires a desired specific pattern of motion as it travels down the bowling lane and towards the bowling pins. In this manner, the pitch or span of the ball is varied to suit the preferences of the bowler.

A plurality of interchangeable thumb and finger inserts are further provided, each of which possesses a differently angled passageway. The purpose behind having interchangeable sleeves is for the bowler, following a trial and error procedure, to arrive upon a combination of thumb and finger inserts which results in the most effective motion dynamics for the bowling ball taking into consideration the bowler's delivery style. Thumb and finger inserts may further be substituted to respond to changing lane conditions. The present invention may further be used to steady the grip of a bowler during the delivery stage of the bowling ball.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 1 is a perspective view of a preferred embodiment of the present invention;

FIG. 2 is a cutaway sectional view of FIG. 1 and enlarging the clarity;

FIG. 3 is an embodiment showing the interchangeable nature of the sleeves of the present invention; and FIG. 4 is a perspective view of an alternate embodiment of the sleeves and inserts.

DETAILED DESCRIPTION OF A PREFERRED EMBODIMENT OF THE PRESENT INVENTION

With reference to FIGS. 1 and 2, the adjustable grip bowling aid kit 10 of the present invention is there shown and comprises a bowling ball 12. A thumb recess 14 and two finger recesses 16 and 18 are formed into the bowling ball 12. Into the thumb recess 14 and finger recesses 16 and 18 are inserted a circular thumb sleeve 20 and first and second circular finger sleeves 22 and 24. The circular sleeves 20–24 each have an inner end 26 and an outer end 28 and are in the shape of a hollow cylindrical tube. The sleeves 20–24 are further defined by circular walls 30, between which hollow cavities exist. Fastening of each of the sleeves 20–24 to the bowling ball recesses 14–18 is accomplished by adhesive 32.

A thumb insert 34 and first and second finger inserts 36 and 38 are provided and are inserted coaxially within the circular walls 30 of the thumb sleeve 20 and finger sleeves 22 and 24, respectively. The inserts 34–38 are of a cylindrical shape making them slidably insertable within the sleeves 20–24.

The thumb and finger sleeves 20–24 further comprise reduced diameter circular walls 40 located at the inner ends 26 of the sleeves 20–24. The reduced diameter walls 40 are inlaid with inwardly directed spiral threads 44. The thumb and finger inserts 34–38 correspondingly comprise reduced diameter sleeve heads 42 also positioned at the inner ends 26 of the sleeves 20–24 when the inserts 34–38 are placed. The insert heads 42 possess outwardly directed spiral threads 45. The inwardly and outwardly directed threads 44 and 45 are capable of being rotatingly nestled within one another for each insert 34–38 placed within sleeves 20–24.

An alternative manner of securing the inserts to the sleeves 120–124 is provided by circular locking ledges 27 located at the inner ends of the sleeves 120–124 and extending radially inwardly as shown on FIG. 4. The ledges 27 are configured with openings 25 that receive axially directed locking tabs 23 provided on the inserts 134–138. Rotation of the locking tabs with respect to the opening 25 locks the inserts 34–38 into place.

Each of the inserts 34–38 further comprise at least one notch 46 cut into the inserts 34–38 approximately at the outer end 28 of the sleeves 20–24. The notches 46 are engaged by a tool 48 which inserts a tool head 49 into the notches 46 and causes the inserts 34–38 to be rotatingly positioned within sleeves 20–24 to the point where the threads 44 and 45 are fully engaged.

The thumb insert 34 and the first and second finger inserts 36 and 38 further comprise, respectively, a thumb passage 50 and first and second finger passages 52 and 54. The passages 50–54 are defined within the inserts 34–38 such that particular forces are exerted on the bowling ball 12 by the thumb and fingers working together to create these specific forces. The forces exerted on the bowling ball 12 in turn encourage the ball 12 to acquire a desired set of actions along the bowling lane.

Referring to FIG. 3, a plurality of interchangeable thumb inserts 34' and first and second finger inserts 36' and 38' are provided. The interchangeable inserts are conveniently stored in a carrying device 39. Each interchangeable thumb or finger insert 34'–38' embodies a differently configured passageway 50–54 which, when the insert is placed into the bowling ball, alters the force vectors delivered to the bowling ball 12 upon release from the bowlers hand. By employing a trial and error procedure, the bowler can determine which combination of thumb and finger inserts 34–38 will result in a dynamic motion of ball 12 best suited to the bowler's delivery and style. The interchangeability of the inserts 34–38 further permits the bowler to adjust the bowling ball 12 dynamics in response to changing lane conditions. The bowling aid kit 10 additionally provides enhanced grip control for the bowler's hand during ball 12 delivery.

While several preferred embodiments of the present invention have been described, it should be apparent that there are ways other than those shown for releasably locking the inserts 34, 36, and 38 in place. Also, where rules such as those of the American Bowling Congress require, the inserts 34, 36, and 38 may be more permanently locked in place, such as by the provision of an overlocking washer (not shown), which might be glued in place. Such a washer would keep the insert in place for a particular tournament or match but would still permit replacement of the insert by breaking the bond of the glue after the match or tournament was concluded, or in the event that after several matches or tournaments further experimentation was considered necessary.

Having described my invention, many modifications thereto will become apparent to those skilled in the art to which it pertains without deviation from the spirit of the invention as defined by the scope of the appended claims.

I claim:

1. An adjustable grip bowling aid kit for a bowling ball comprising:

a cylindrical thumb sleeve fastenable within a thumb recess of said bowling ball, said thumb sleeve having an internal end wall and a threaded aperture provided through said internal end wall;

a plurality of interchangeable thumb inserts adapted to be coaxially received in said cylindrical thumb sleeve and removed therefrom, each of said thumb inserts having a threaded insert head adapted to be threadably received in said threaded aperture of said thumb sleeve to lock said thumb inserts in said thumb sleeve and a differently configured thumb passage for receiving a bowler's thumb;

first and second finger sleeves fastenable within finger recesses of said bowling ball, said first and second finger sleeves having an internal end wall and a threaded aperture provided through said end wall; and a plurality of interchangeable first and second finger inserts adapted to be coaxially received in and removed from said first and second finger inserts, respectively, said first and second finger inserts each having a threaded insert head proved at an internal end, said threaded insert heads adapted to threadably engage said threaded apertures of said first and second finger sleeves, respectively, to lock said first and second finger inserts in said first and second finger sleeves, respectively, each of said first and second finger inserts having a differently configured finger passage for receiving a bowler's finger.

2. The bowling aid kit of claim 1 wherein said thumb and said first and second finger inserts each comprise in addition at least one notch cut into said insert at an end opposite said internal end, said notch being engageable by a tool to rotatingly thread said insert onto and from said sleeve.

3. The bowling aid kit of claim 1 wherein said thumb and finger passages of said thumb and said first and second finger inserts coact with the thumb and first and second fingers of a bowler's hand to alter the forces, and thus the pitch and/or span, imparted to said bowling ball as said bowling ball is released.

* * * * *